US009205697B2

(12) United States Patent
Ashtiani et al.

(10) Patent No.: US 9,205,697 B2
(45) Date of Patent: Dec. 8, 2015

(54) METHOD FOR COLOR MARKING METALLIC SURFACES

(71) Applicants: Mansour Ashtiani, Novi, MI (US); Ehab Kamal, Novi, MI (US); Lynn D Da Deppo, Bloomfield Hills, MI (US); Eric Taylor, Farmington Hills, MI (US); Khalid Kamal, Novi, MI (US); Yousef Kamal, Novi, MI (US)

(72) Inventors: Mansour Ashtiani, Novi, MI (US); Ehab Kamal, Novi, MI (US); Lynn D Da Deppo, Bloomfield Hills, MI (US); Eric Taylor, Farmington Hills, MI (US); Khalid Kamal, Novi, MI (US); Yousef Kamal, Novi, MI (US)

(73) Assignee: HUF NORTH AMERICA AUTOMOTIVE PARTS MFG. CORP., Milwaukee, WI (US)

( * ) Notice: Subject to any disclaimer, the term of this patent is extended or adjusted under 35 U.S.C. 154(b) by 0 days.

(21) Appl. No.: 14/145,163

(22) Filed: Dec. 31, 2013

(65) Prior Publication Data

US 2014/0354755 A1 Dec. 4, 2014

Related U.S. Application Data

(60) Provisional application No. 61/828,037, filed on May 28, 2013.

(51) Int. Cl.

| | |
|---|---|
| ***B41M 5/24*** | (2006.01) |
| ***B41M 5/26*** | (2006.01) |
| ***B44C 1/22*** | (2006.01) |

(52) U.S. Cl.

CPC ..... *B44C 1/228* (2013.01); *B41M 5/24* (2013.01); *B41M 5/262* (2013.01)

(58) Field of Classification Search

CPC ..... B23K 26/08; B44C 1/228; B41M 5/262; B41M 5/24

USPC ..... 347/232

See application file for complete search history.

(56) References Cited

U.S. PATENT DOCUMENTS

| | | | | |
|---|---|---|---|---|
| 6,313,436 | B1 * | 11/2001 | Harrison | 219/121.85 |
| 2001/0030002 | A1 * | 10/2001 | Zheng et al. | 148/241 |
| 2003/0085209 | A1 | 5/2003 | Lu | |
| 2008/0139707 | A1 | 6/2008 | Kawakami et al. | |
| 2011/0315667 | A1 | 12/2011 | Reichenbach et al. | |

FOREIGN PATENT DOCUMENTS

WO 2006129972 A1 12/2006

OTHER PUBLICATIONS

Vorobyev, et al., Colorizing Metals with Femtosecond Laser Pulses, Applied Physics Letters, 2008, 92:041914-1-041914-3.

Vorobyev, et al., Nanochemical Effects in Femtosecond Laser Ablation of Metals, Applied Physics Letters, 2013, 102:074107-1-074107-5.

Datacolor, Colorimetric Fundamentals, CIE 1976 L*a*b* (CIELAB), Copyright 2009 Datacolor, 2 pages.

(Continued)

*Primary Examiner* — Sarah Al Hashimi

(74) *Attorney, Agent, or Firm* — Honigman Miller Schwartz and Cohn LLP; Matthew H. Szalach; Jonathan P. O'Brien

(57) ABSTRACT

A method of color marking a metal or metal-plated part is described involving setting at least one laser parameter of a laser, such as the power, scan speed, Q-switch, spot size, line separation, and scan repetition, and then energizing a metal containing surface layer of the part using the laser to change the color reflected by the surface layer.

18 Claims, 6 Drawing Sheets

(56) References Cited

OTHER PUBLICATIONS

PCT International Search Report and Written Opinion, PCT/US2014/039658, Sep. 24, 2014, 11 pages.

Qizhi Dong, Jiandong Hu, Jianshe Lian, Zuoxing Guo, Jiwei Chen, Bo Chen, Oxidation behavior of Cr films by Nd:YAG pulsed laser, Scripta Materialia, pp. 1373-1377, vol. 48, iss. 9, Elsevier Ltd., Feb. 14, 2003.

P. Laakso, S. Ruotsalainen, H. Pantsar, R. Penttila, Relation of laser parameters in color marking of stainless steel, 12th Conference on Laser Processing of Materials in the Nordic Countries (NOLAMP), Copenhagen, Denmark, Aug. 24, 2009.

* cited by examiner

METHOD FOR COLOR MARKING METALLIC SURFACES

STATEMENT CONCERNING FEDERALLY SPONSORED RESEARCH OR DEVELOPMENT

This application claims priority to U.S. Provisional Patent Application No. 61/828,037 filed on May 28, 2013.

FIELD OF THE INVENTION

The invention pertains to a method for color marking a metal part or surface of a plated part. In particular, the invention pertains to direct color marking of metallic parts via a laser irradiation process.

BACKGROUND OF THE INVENTION

Labeling of plastics, ceramics, glasses and metals by irradiation has long been known in the art and a number of methods exist for achieving these labels or marks. Marks can be made on the surface of a part by physically etching away the surface, by applying additional material to the surface, or by inducing a physical or chemical change at or near the surface. When irradiation of a surface is achieved with a laser, for example, all of the aforementioned techniques are possible.

Many examples exist of the use of lasers to achieve color marks on plastic or ceramic parts, yet there are few examples of methods for achieving colored marks on metal parts and in particular, chromium plated or chromed parts. With regard to plastic parts, methods for discoloring or decoloring a surface are known in the art. This may be achieved by creating a composite material combining a thermoplastic polymer, a mineral black pigment and a coloring agent. When the material is irradiated, the carbon black absorbs the radiation and vaporizes leaving the color of the colorant material to show. Additional examples exist wherein the coloring agent is formulated to produce more than one color when irradiated with a plurality of different laser sources. For example, U.S. application 2008/0139707 A1 teaches a method for producing a multi-color laser marking on a molded article. While it is possible to create composite materials comprising metals, the same techniques have yet to be applied for the production of colored marks on metal parts or surfaces on a metal or non-metal (e.g. plastic) part.

U.S. Pat. No. 6,313,436 discloses a method for laser-marking the surface of a material by applying a coating to the surface and then irradiating the coating with a laser. This method is an example of an additive process involving the use of a laser to adhere additional material to a surface. Therefore, the method may produce a color marking on a surface by including the colorant in the added coating material. Moreover, the method is less dependent on the characteristics of the part. However, one drawback is that this approach does not directly alter the appearance of the original material itself.

In direct metal marking material is removed in the micron range. Examples of metals that can be labeled include chromium, aluminum, steel, iron, titanium and tin. Composite materials such as part with a chromium-nickel layer may also be labeled with a laser wherein a layer of chromium is removed in the micron range leaving the nickel layer undamaged so that corrosion protection of the component is retained. Currently there are a number of methods for achieving black or gray marks through the use of irradiation of a metal surface. However, there are few if any examples of methods for generating color marks.

A recent study with a Titanium:sapphire laser system demonstrated the ability to alter the appearance of an aluminum surface by applying femtosecond laser pulses (Vorobyev, A. Y. and C. Guo (2008). "Colorizing Metals with Femtosecond Laser Pulses." Applied Physics Letters 92(4)).The method resulted in gold, black or grey color marking on the aluminum. Platinum and palladium surface were also studied. While this example is a unique method for color marking a surface, the method (i) is not known to work for all metal surfaces, (ii) requires a specialized and expensive laser compared with other marking systems, and (iii) is time intensive with linear marking speeds on the order of 1 mm per second.

What is needed and is not disclosed in the art is a method of making commercially desirable colored marks on metal surface without the use of pigments, dyes or other additives materials. Preferably, the process would also be able to allow for direct conversion of metal surfaces. In addition the process should be able to make the marks as quickly as possible to allow for commercial-scale production capacity.

SUMMARY OF THE INVENTION

The present invention provides a novel method for color marking a metal containing surface layer, such as a chromium containing layer of a plated part. The method allows for direct conversion of metals such as currently chromed parts including door handle covers and bezels into various color and color effects including color transitions and shades. This method occurs by the direct interaction of the laser beam with the surface of a metal, such as a chromium nickel material. Interaction of the laser beam with a surface may include, but is not limited to, etching (removal) of the surface, deposition of additional material and oxidation of the surface.

It is therefore an advantage of the present invention to offer greater design freedom and functionality. In one aspect, a manufacturer may apply color marking of parts, such as a chromed part, for brand and series differentiation, personalization and for achieving a particular aesthetic. To this end, marks can be achieved monochromatically or in multiple colors.

It is a further advantage of the present invention to provide a simplified and cost effective means of applying a mark to a part, such as a chromed part. In one aspect the invention may obviate post painting of parts. In addition, the invention may be implemented as a paint adhesion promoter for a part if painting is still desired. The methods of the present invention may reduce overall process times for marking parts and may further reduce the need for brand associated mold tooling costs.

In summary, an overall advantage of the present invention is to reduce costs, improve quality and durability, and improve freedom and functionality in the design and implementation of a process for applying a mark to a part, such as color marking a chromed part.

DETAILED DESCRIPTION OF THE PREFERRED EMBODIMENT

The methods of the present invention may be carried out to produce a variety of colorful marks on a substrate. Accordingly, marks have been achieved with colors including not only black and white, but also varying shades of grey, blue, orange, green, tan, and the like. In addition to color marking parts with a single color, the present invention may be applied to marking parts with more than one color or marking parts to obtain a shading or gradient effect. Methods and examples for obtaining the aforementioned colored marks are described hereinafter.

A general understanding of the process and apparatus of this invention can be obtained by reference to the Figures. The Figures may not be drawn to scale and have been simplified by the deletion of a large number of apparatuses customarily employed in a process of this nature, such as electrical connections, controls systems, sensors, etc. which are not specifically required to illustrate the performance of the invention. Furthermore, the illustration of the process of this invention in the embodiment of a specific drawing is not intended to limit the invention to specific embodiments set out herein. Lastly, although a process for color marking of a chromed part is illustrated by way of an example, other color marking schemes are contemplated.

Figure 1A:
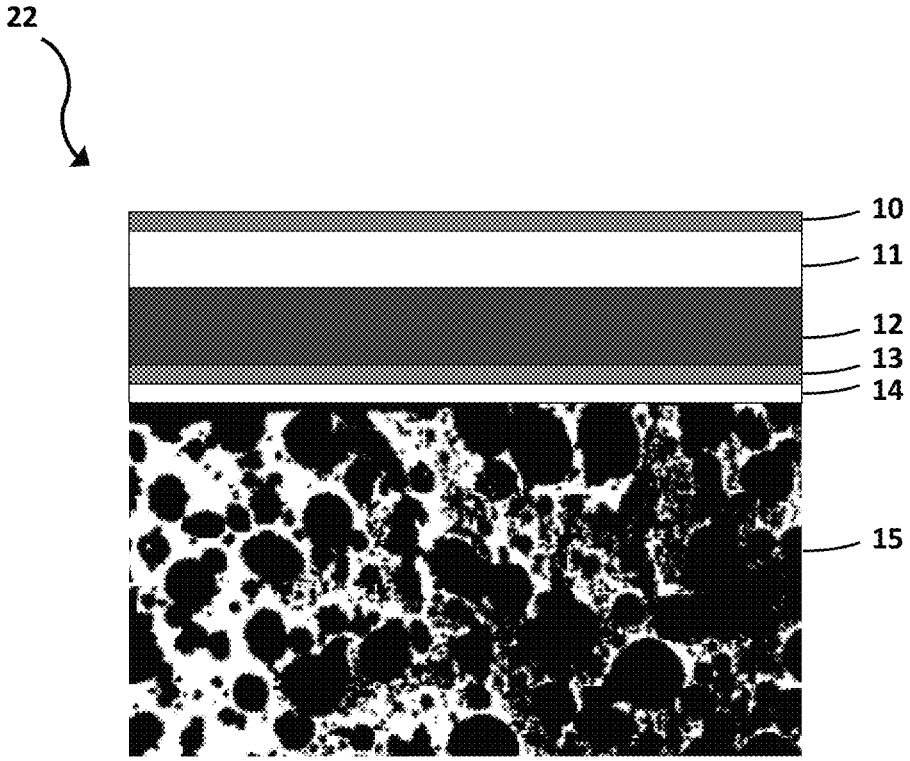
FIG. 1A is of schematic view of a part suitable for color marking.

FIG. 1A is a cross-sectional view of one example of a plated part for color-marking. The chromed part 22 comprises a substrate 15 and a number of layers of different materials on the surface of a substrate 15. The substrate 15 can be comprised of acrylonitrile butadiene styrene (ABS) or a polycarbonate/ABS composite (PC/ABS). The first layer 14 on the surface of the substrate 15 is a first nickel metal layer with a thickness of about 1 μm followed by a second layer 13, which can be a thin layer of chromium on the order of 3 μm. A third layer up from the surface of the substrate 15 is a copper metal layer with a thickness of about 20 μm. Finally, the fourth layer 11 and fifth layer 10 from the surface of the substrate 15 represent a second nickel layer and a second chromium layer. The second nickel layer can be about 15 μm and the second (outermost) chromium layer cab be about 0.5 μm. In total, the metal layer on the surface of the substrate 15 is about 40 μm.

Figure 1B:
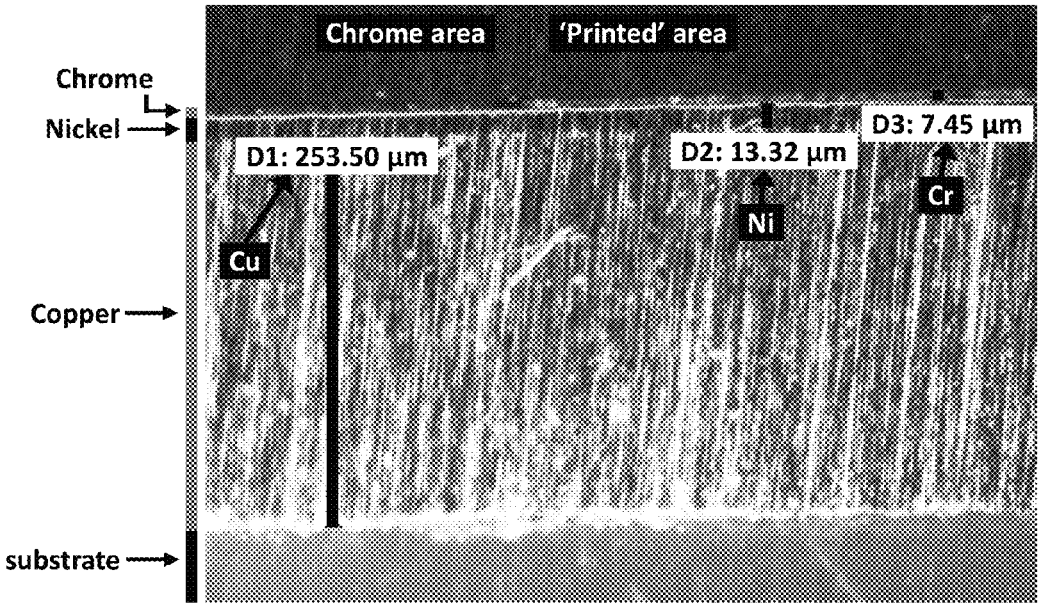
FIG. 1B is a microscopic image of a cross-section of a part for color marking.
Figure 1C:
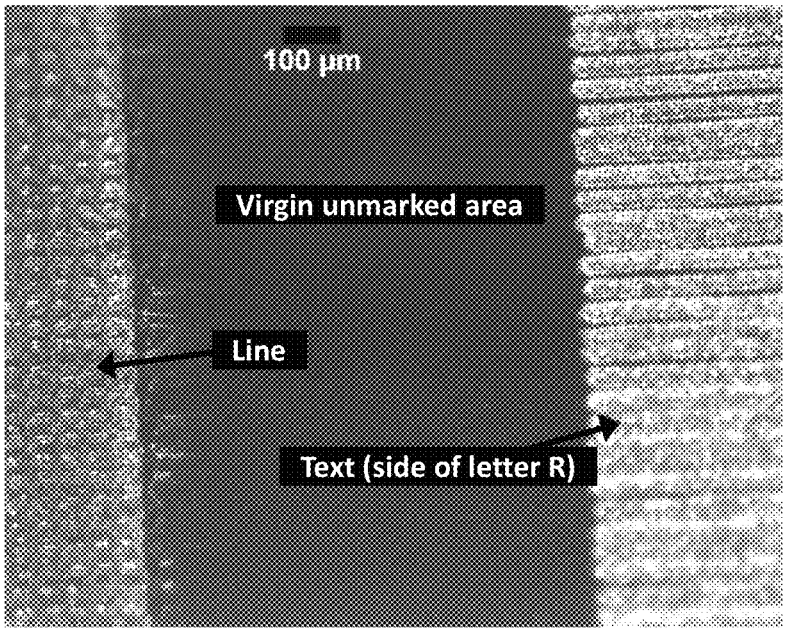
FIG. 1C is a microscopic view of line and text markings on a surface of a part suitable for color marking.
Figure 1D:
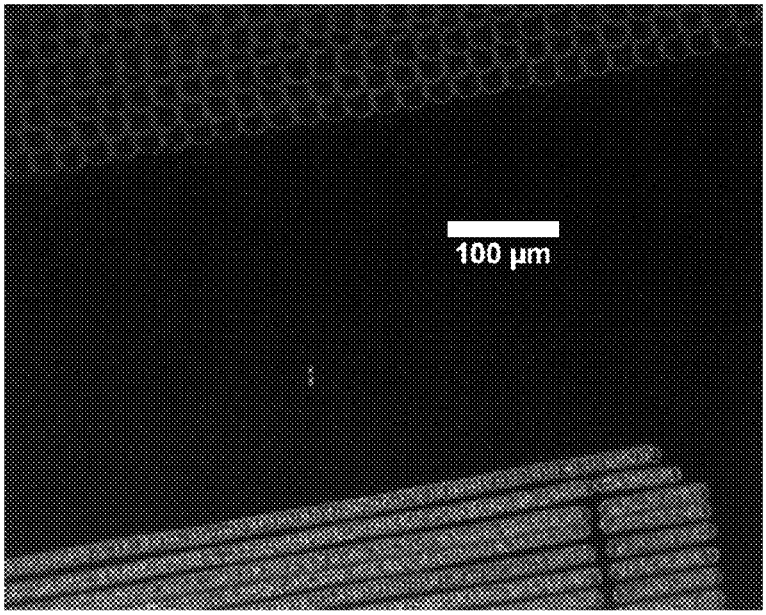
FIG. 1D is a microscopic view of line and text markings on a surface of a part suitable for color marking.
Figure 1E:
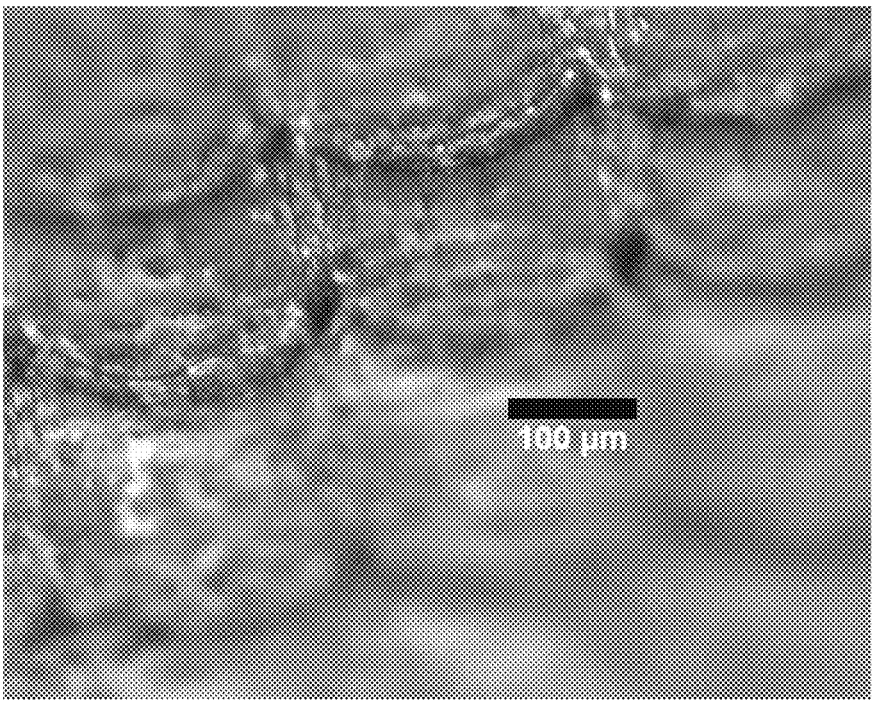
FIG. 1E is an enhanced microscopic view of line markings on a surface suitable for color marking.
Figure 1F:
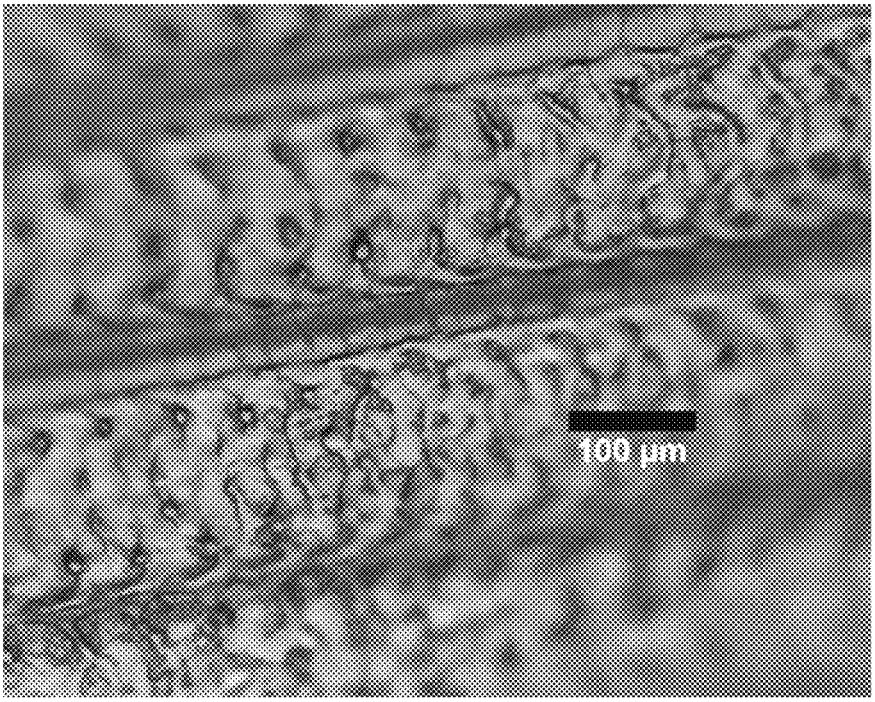
FIG. 1F is an enhanced microscopic view of text markings on a surface suitable for color marking.

FIG. 1B is a microscopic view of an example of a part for color marking showing dimensions of copper, nickel and chromium layers on a substrate. In the example of FIG. 1B, the copper layer is 253.5 μm, the nickel layer is 13.32 μm and the chromium layer is 7.45 μm. Whereas FIG. 1B shows a cross-sectional view of a chromed substrate, FIGS. 1C, 1D, 1E and 1F show a number of views of surfaces marked with lines and text.

Figure 2:
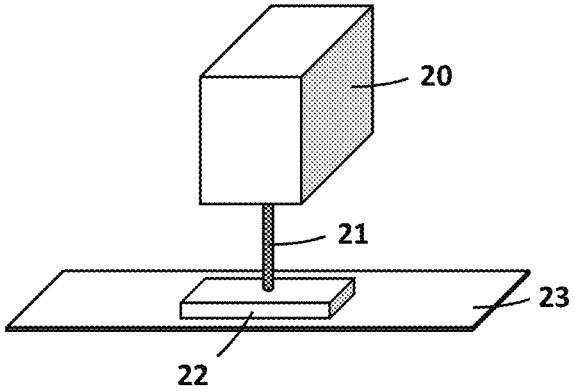
FIG. 2 is a schematic of an apparatus for color marking a part.
Figure 3:
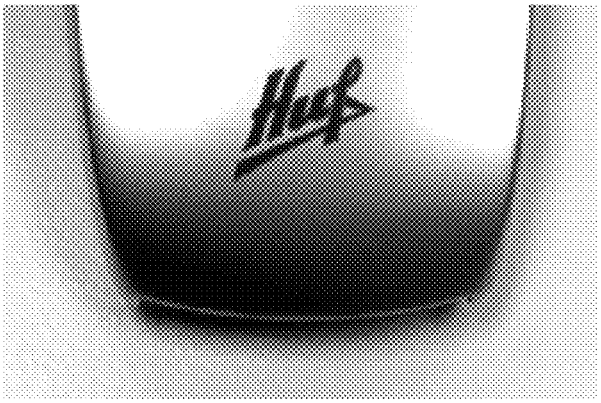
FIG. 3 is a non-limiting example of a color marked part according the present disclosure.

FIG. 2 shows a simplified schematic of a color-marking apparatus. In this example, the apparatus comprises a laser source 20, a laser beam 21, which is incident on the surface of a chromed part 22. The chromed part rests on a stage 23. The chromed part 22 can be moved beneath the incident laser beam 21 in order to color mark the part 22. Alternatively, the laser beam 21 itself or the laser source 20 can be manipulated in order to move the laser beam 21 across the surface of the chromed part 22 in order to produce the color marking. One example of a color marked part in accordance with the present disclosure is shown in FIG. 3. in which a black mark was made on a matte finished chromed part.

In accordance with the present invention, various substrates or parts can be marked. For example the present method may be used to mark chromium (a.k.a., chrome), chromium-nickel, stainless steel, iron and titanium. In a preferred embodiment of the present invention, marking is implemented on a substrate having a chrome layer or surface.

Exemplary substrates that contain a chrome or chrome-nickel surface layer will comprise a substrate material. Such substrate materials may be metals or metal alloys such as chromium, chromium-nickel, steel, titanium, aluminum and other metals. One preferred substrate material is a thermoplastic such as ABS or a PC/ABS. Other substrate materials may include any suitable plastic material, such as polyacrylates, polyamides, polybutylene terephthalate, polyethylene terephthalate, polycarbonates, polyesters, polyethylene, polypropylene, polystyrene and polyvinylacetate.

The surface of the substrate material will be treated by the addition of several layers of other materials. For example, the surface of an ABS substrate may comprise one or more layers of copper, nickel, and chrome. More preferably, the ABS surface may comprise a nickel layer followed by a copper layer follower by a second nickel layer and an outermost chrome layer. These layers will be on the order of 0.1 to 100 μm in thickness. In particular, the thickness of the chromium layer can affect the types of colors or markings that may be achieved. Generally, the thickness of the chromium layer will between 0.05 to 7 μm. Preferably, the thickness of the chromium layer is between 0.1 to 1.5 μm. More preferably, the thickness of the chromium layer is between 0.5 to 1.0 μm. Methods for applying a chromium layer to a surface (e.g., chroming, chrome plating) are well known in the art. Additionally, other metals layers such as stainless steel, iron and titanium may be color marked using a laser in a manner analogous to marking a chromium layer on a surface according to the present invention. Moreover, the surface of the material can be treated to achieve various finishes, such as a matte, gloss, pearl, satin and the like either before or after the color marking process.

The size and shape of the material to be marked may vary. Both two-dimensional and three-dimensional surfaces can be marked using the method of the present invention. Furthermore, types of parts that can be marked will include automotive parts, automotive glass, aerospace parts, medical devices, electronic devices, tools, consumer products, packaging, glass bottles, metal cans, metal tags, bricks, tiles, plumbing, electrical and construction supplies, lighting and the like.

In order to produce a color marking, a beam is used to irradiate the surface of the material to be marked. Typically, a laser can be used to as the source of radiation. Examples of types of lasers include gas, solid-state, semiconductor, dye, excimer and free-electron lasers.

Examples of gas lasers includes helium (He) or helium-neon (HeNe), noble gas ion, helium-cadmium (HeCd), metal vapor, carbon dioxide gas ($CO_2$) and the like. Solid-state lasers includes ruby, neodymium (Nd), variable-wavelength solid-state and the like. Semiconductor lasers may be inorganic or organic based including gallium-arsenide (GaAs), gallium-aluminum arsenide GaAlAs, indium-gallium-arsenide (InGaAs), indium-phosphide (InP) and the like. Additionally, a semiconductor laser-excited solid-state laser using neodymium-doped yttrium aluminum garnet (Nd:YAG), neodymium-doped yttrium, gadolinium or lutetium orthovanadate (Nd:$YVO_4$, Nd:$GdVO_4$, Nd:$LuVO_4$) neodymium-doped yttrium lithium fluoride (Nd:YLF), or the like also can be used. The laser beam described above may be used singly or in combinations of two or more types thereof.

A preferred laser for color marking on a metal surface has a wavelength of 1,064 nm such as a diode or lamp pumped Nd:$YVO_4$ laser or an Nd:YAG laser. Alternative emission wavelengths are 914 and 1342 nm. Such a laser has a maximum power of 200-300 kW, a continuous wave (CW) output of 8 to 13 W and a Q-switch frequency of 1 to 400 kHz with a pulse width of 2-100 nanoseconds. Color markings are achieved by operating the laser with a Q-switch frequency in the range of 20 to 30 kHz and a scan speed of 800 to 1200 mm per second. Operating the laser in a Q-switching mode generates a pulsed laser output as opposed to a continuous output mode. This allows for surface irradiation with a much greater power output from the laser source compared with continuous operation. Furthermore, scanning refers to the rate at which the laser traverses the surface of the part to be marked.

Scanning speed determines how quickly a part can be marked with a given design, and depending upon the apparatus used can range between 1 mm/s and about 12000 mm/s. Scanning is achieved by moving either the beam source or the part itself. For example, mechanical stage can be used to move a part in one (x-axis), two (y-axis) or three (z-axis) dimensions. Three dimensional mechanical stages can facilitate marking of non-planar surfaces. Alternatively, it is possible to control the focus distance for the laser beam emitted from the laser while varying the beam diameter with a Z-scanner. This technique helps to suppress changes in the spot size of the laser, variations in the marking area, and warping around the minimum limits at the center of the marking area and around the marking area. This allows for the laser to handle a large number of shapes, including uneven surfaces, tilted surfaces, cylinders, or cones, while controlling the laser spot in real time to produce perfect marking for 3D objects.

In certain embodiments, a method of color marking a plated surface may include varying at least one laser parameter, such as the power, scan speed, Q-switch, spot size, line separation, and scan repetition to effect the visual appearance of said metal containing surface layer. Varying the aforementioned parameters may result in one or more different visual effects. For example, the metal containing surface layer may take on a shaded appearance. Alternatively, the metal containing surface may have the appearance of a one or more colors, or a color gradient.

The atmospheric environment in which the laser marking process takes place can have an effect on the outcome of the process. For example, laser marking in the presence of air may have an effect on the extent of oxidation of a surface on the part to be marked. Therefore, it is desirable to control the composition of the atmospheric environment when color marking a part, such as through the use of a nitrogen atmosphere or "blanket". Suitable atmospheric gases which may be used in addition to or instead of nitrogen include noble gases (e.g., helium, neon, argon, krypton and xenon), semi-inert gases (e.g., carbon dioxide, oxygen, hydrogen), and other gases such as water vapor or nitric oxide. Under certain conditions, it may be desirable to use a relatively pure (homogenous) composition, while under other circumstances, it may be desirable to use a mixture of gases.

The markings on the surface of the part are prepared by irradiating, i.e. energizing, the surface of the part with a beam such as a laser to change the light wavelength reflectivity of the surface of the part, which results in the part having a color that is different compared to prior to irradiation. In one embodiment of the present invention, the marking is the result of the depletion or rearrangement of the surface layer as opposed to the deposition of additional material onto the surface. For example, irradiation may result in a physical etching of the surface layer. In another embodiment, irradiation may result in the physical rearrangement of the surface such as via the formation of microscopic structures. In yet another embodiment, irradiation may result in the oxidation of the surface, wherein the oxidation results in the appearance of one or more colored marks.

One additional step of the method for color marking a metal containing surface may be to apply a treatment to the surface after an initial laser marking step. This subsequent treatment step may include applying a coating to the marked surface. Alternatively, the treatment step may include a further irradiation step or a plating process. The outcome of such a treatment may be to prevent oxidation or further oxidation of the marked surface. The treatment may also prevent other types of physical or chemical deterioration, abrasion, erosion, corrosion, and other forms of wear on the metal surface.

A number of factors can affect the cycle time for producing a color marked part. Factors that have an effect on the cycle time can include the size of the mark, degree of detail and resolution of the mark, color of the mark, power of the laser or other energy source, laser type, spot size and lens selection, degree of overlap of marks, choices of laser path for executing the design, and so forth. In order to reduce the cycle time, or the time needed to complete the color marking process and produce a desired design, it can be preferable to increase the power (Watts) of the laser. Alternatively, a different laser or lens configuration can be used to increase the spot size of the laser in order to decrease the cycle time. Moreover, the choice of a material with a lower conductivity and therefore, reduced energy dissipation can result in lower cycle times. Typically, it is desirable to minimize the cycle time as much as possible. Generally, the cycle time for color marking a part can be less than about 60 minutes, more preferably less than about 20 minutes and most preferably less than about 1 minute.

EXAMPLE 1

A method for color marking a chromed part with a white mark is carried out with Keyence 3-Axis $YVO_4$ Laser Marker MD-V9920FA laser. The laser has a CW output maximum of 8 W and is set to operate at 80% CW output or 6.4 W. The laser is operated in a Q-switching mode with a setting of 90 kHz. The focus position of the laser is ±21 mm in any direction within a 3D space from the standard distance.

A design for color marking is prepared using a typical computer aided drafting (CAD) software known in the art such as AutoCAD. The design can be mapped to a three dimensional surface using a mapping method such as sticker mapping or projection mapping. In sticker mapping, the goal is to mark the image onto the surface of the part like affixing a sticker. The image looks different when viewed from an infinite distance. Projection mapping is when the image is projected and marked on a three dimensional shape such that the image looks the same when viewed from an infinite distance.

The image is color marked onto the surface of the part with a scanning speed in one dimension of 1000 mm per second, a spot variable of 0, a repetition number of 1 and a line separation of 0.04 mm. The spot variable describes the variation in the spot size of the laser on the surface if the part, the repetition number describes the number of times the laser retraces its pattern on the surface as the mark is applied to the part and the line width is defined as the distance between laser markings in the dimension perpendicular (e.g., y-axis) to the dimension in which the laser is scanning (e.g., x-axis).

Laser irradiation of chromed surface of the part results in a physical change to the chrome surface and visible result is the appearance of a white marking on surface of the part.

EXAMPLE 2

A method for color marking a chromed part with a blue mark is carried as in example 1 with the following differences: (1) the linear scanning speed is set to 1170 mm per second and (2) the laser is operated in a Q-switching mode with a setting of 24 kHz.

EXAMPLE 3

A method for color marking a chromed part with an array of a variety of colored marks is carried as in example 1 with the following differences: (1) the linear scanning speed is varied in one dimension (e.g., x-axis) from 800 to 1200 mm per second and (2) the laser is operated in a Q-switching mode with the frequency varied in a second dimension (e.g., y-axis) from 20 to 30 kHz.

EXAMPLE 4

A method for color marking a chromed part with a black mark is carried as in example 1 with the following differences: (1) the linear scanning speed is set to 9 mm per second, (2) the laser is operated in a Q-switching mode with a setting of 30 kHz and (3) the line separation is set to 0.06 mm.

EXAMPLE 5

A method for color marking a chromed part with an orange mark is carried as in example 1 with the following differences: (1) the linear scanning speed is set to 142 mm per second, (2) the laser is operated in a Q-switching mode with a setting of 16 kHz and (3) the line separation is set to 0.06 mm.

EXAMPLE 6

Salt spray testing was performed to determine the ability of color marked parts to withstand corrosion. Color marked parts were placed in a salt fog chamber and exposed to an aqueous salt solution comprising 5% NaCl. After 144 hours, the color-marked parts were washed with fresh water and dried for 24 hours. At the conclusion of the testing, it was observed that the color marked parts showed no signs of corrosion.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

The invention claimed is:

1. A method of color marking a metal surface of a part, said method comprising:

setting at least one laser parameter of a laser, said at least one laser parameter selected from a group consisting of power, energy, scan speed, Q-switch, spot size, line separation, and scan repetition;

changing the reflectivity of said metal surface by energizing said metal surface of said part using the laser, wherein following said step of energizing said metal surface, said surface reflects a light wavelength that is different from a light wavelength reflected by the surface prior to said energizing said metal surface, such that a user views a color of the metal surface following said energizing said metal surface that is different than a color of the metal surface prior to said energizing said metal surface and wherein said metal surface is oxidized and a color change is observed as a result of oxidation of the metal surface; and treating said metal surface to inhibit further oxidation of said metal surface.

2. The method as in claim 1, in which said part includes a metallic substrate supporting said metal surface.

3. The method as in claim 2, in which said metallic substrate is selected from a group consisting of iron, steel, titanium, copper, and alloys thereof.

4. The method as in claim 1, in which said laser has a maximum power output, and said at least one laser parameter is a set to a percentage of said maximum power output.

5. The method as in claim 1, in which said maximum power is about 8 watts.

6. The method as in claim 1, in which said at least one parameter is a scan speed set to between about 1 mm/s and about 12000 mm/s.

7. The method as in claim 6, in which said scan speed is set to between about 900 mm/s and about 2400 mm/s.

8. The method as in claim 1, in which said metal surface overlies a nickel layer.

9. The method as in claim 1, in which said metal surface comprises chrome.

10. The method as in claim 1, in which said at least one laser parameter is varied to effect the visual appearance of said metal surface.

11. The method as in claim 10, in which said metal surface appears to be shaded.

12. The method as in claim 1, in which said metal surface is covered with a gas as said laser energizes said metal surface.

13. The method as in claim 12, in which said gas is nitrogen.

14. The method of claim 1, in which the color of the metal surface following said energizing said metal surface is selected, from black, white, blue and orange.

15. A color marked part produced using the method as in claim 1.

16. The method as in claim 1, in which said part comprises a plastic substrate and at least one layer on a surface of said substrate, wherein an outermost layer of said at least one layer is said metal surface.

17. The method as in claim 16, in which said metal surface is chrome.

18. A method of color marking a surface of a part, said method comprising:

setting at least one laser parameter of a laser, said at least one laser parameter selected from the group consisting of power, scan speed, Q-switch, spot size, line separation, and scan repetition;

energizing a metal containing surface layer of a part using said laser, wherein following said energizing said metal containing surface layer, said surface layer reflects a light wavelength that is different from a light wavelength reflected by said surface layer prior to said energizing said metal containing surface layer, such that a user views a color of said surface layer following said energizing said metal containing surface layer that is different than a color of said surface layer prior to said energizing said metal containing surface layer, wherein said metal containing surface layer is oxidized, and wherein a color change is observed as a result of oxidation of said metal containing surface layer; and treating said metal containing surface layer to inhibit further oxidation of said metal containing surface layer.

* * * * *